US005848565A

United States Patent [19]

Thoma

[11] Patent Number: 5,848,565

[45] Date of Patent: Dec. 15, 1998

[54] RADIAL PISTON MACHINES

[75] Inventor: Christian Helmut Thoma, Jersey, United Kingdom

[73] Assignee: Unipat AG, Glarus, Switzerland

[21] Appl. No.: 759,420

[22] Filed: Dec. 5, 1996

[30] Foreign Application Priority Data

Dec. 6, 1995 [GB] United Kingdom ..... 9525028

[51] Int. Cl.[6] ..... F04B 1/04; F04B 27/04

[52] U.S. Cl. ..... 91/491; 91/497; 92/72; 92/121; 417/219; 417/273

[58] Field of Search ..... 417/273, 219; 92/72, 12.1; 91/491, 497

[56] References Cited

U.S. PATENT DOCUMENTS

| | | | |
|---|---|---|---|
| 755,759 | 3/1904 | Franzen . | |
| 1,250,170 | 12/1917 | Hele-Shaw et al. | 91/491 |
| 1,656,544 | 1/1928 | Thoma | 91/491 |
| 2,205,913 | 6/1940 | Stacy . | |
| 2,260,859 | 10/1941 | Neuland . | |
| 2,800,857 | 6/1957 | Yarmak . | |
| 2,936,589 | 5/1960 | Quintilian . | |
| 3,087,437 | 4/1963 | Henrichsen | 417/219 |
| 3,750,533 | 8/1973 | Thoma | 91/498 |
| 5,079,994 | 1/1992 | Berbuer | 91/491 |
| 5,081,907 | 1/1992 | Nagel et al. | 91/497 |
| 5,201,260 | 4/1993 | Fetting et al. | 91/491 |
| 5,249,512 | 10/1993 | Christenson | 91/491 |
| 5,400,594 | 3/1995 | Hayens | 92/72 |
| 5,452,646 | 9/1995 | Fahnle | 91/497 |
| 5,503,535 | 4/1996 | Thoma et al. | 417/219 |
| 5,651,301 | 7/1997 | Thoma et al. | 417/219 |

*Primary Examiner*—Timothy Thorpe
*Assistant Examiner*—Ted Kim
*Attorney, Agent, or Firm*—Young & Thompson

[57] ABSTRACT

A radial piston hydrostatic machine having an outer housing structure and defining an internal chamber, a drive-shaft supported in the housing and operatively connected to the cylinder-barrel, the cylinder-barrel having a number of radial cylinders, each cylinder containing a piston such that the pistons bear on the track-ring, the track-ring eccentrically position within the internal chamber by means of fixed abutment means in the housing, the abutment means disposed radially adjacent the track-ring for resisting the action of the pistons on the track-ring and thereby suppressing vibration emanating from the track-ring.

17 Claims, 1 Drawing Sheet

RADIAL PISTON MACHINES

FIELD OF THE INVENTION

This invention relates to positive displacement reciprocating piston machines of the type where pressurized fluid within a cylinder causes a piston to be displaced in the cylinder. The machine may be used as a hydraulic motor or as a pump.

For purposes of definition, a hydrostatic piston machine of the radial piston variety can either be of the type where a rotary cylinder-barrel is mounted for rotation on a ported pintle-valve or where the cylinder-barrel is mounted for rotation on a shaft. In the second type, a stationary axial distributor-valve is fluidly connected to the cylinder-barrel to act as the means for porting to the individual cylinders.

In the type of radial piston machine employing a pintle-valve, the cylinder-barrel is mounted for rotation about the longitudinal axis of the pintle-valve, and where the cylinder-barrel is provided with a series of cylinders. Each cylinder contains a piston and each piston is operatively connected to the surrounding annular track-ring. The annular track-ring may be positioned to be in an eccentric relationship with respect to the rotating axis of the machine to determine the amount of piston stroke. The arcuate-slots in the pintle-valve are arranged to communicate through a series of fluid-passages which connect with fluid inlet and outlet conduits attached to the exterior of the housing of the machine. In the example of a hydraulic motor, fluid movement between the inlet and outlet conduits is accompanied by radial displacement of the pistons as pressurized fluid on entering each cylinder acts against the underside of the piston contained therein to cause the piston to move towards the open end of the cylinder. As a consequence of the annular track-ring being eccentrically positioned relative to the rotational axis of the machine, the piston by means of engaging with its respective slipper set at an angle, creates a turning moment on the cylinder wall of the cylinder which causes rotation of the cylinder-barrel, the rotation being transmitted via a mis-alignment coupling to the drive-shaft.

Known radial piston machines presently available in the market for high-pressure operation have a number of disadvantages that the present invention overcomes.

Some of the known disadvantages are as follows: difficulties restraining the noise and vibration emanating from the track-ring and the surrounding housing support structure; difficulties during the assembly of the machine due to the requirement for a heat-shrink fit for both the pintle-valve and track-ring into the housing; poor starting torque efficiency when the hydrostatic motor operates from rest under load.

It is certainly well known by those familiar with the art that reciprocating piston machines can be extremely noisy in operation, and sometimes the components of these machines vibrate quite violently. The number of pistons and cylinders employed and the speed of rotation of the drive-shaft may vary considerably but in a typical case wherein 9 cylinders are used and the speed or rotation is 1,500 rev/min, there are 13,500 successive impulses or fluid pressure periods per minute or 225 impulses per second. During the period of one full revolution of of the cylinder-barrel, at the instant when the fluid contained within one of the cylinders becomes pressurized, a force impulse is transmitted by the piston to the track-ring. As each successive cylinder becomes pressurized, each piston in turn transmits a further impulse to the track-ring. Collectively, these impulses cause the track-ring to shake and vibrate. The effect of such vibration becomes greatly amplified because the vector resultant of all the pistons subjected to pressurized cylinders is continually changing in value and direction. Since the pressure applied to the fluid or liquid used may be as much as 350 bar or even more on occasion, the machine components are stressed in rapid succession. The amplitude of the resulting strains is small due to the rigidity of construction and although the strained members are of rather small area, there is still much resulting vibration by the track-ring. Such described difficulties can become particularly acute in instances where the track-ring is supported directly by the housing is a mode whereby such impulses are transmitted directly to the housing which can act as an amplifier. The surrounding housing therefore serves as a resonator which receives the impulses or vibrations of the device from the track-ring and amplifies the same, producing objectionable sounds and noises. One of the objects of the present invention is to substantially reduce such sounds and noises associated with the high-pressure operation of such hydrostatic machines.

In known radial piston machines of the fixed displacement type, the track-ring is fixed to the housing and is thereby prevented from moving. The track-ring may be bolted to the housing or in some instances, is known to be a neat shrink fit within a register or recess provided in the housing. In either case the track-ring is prevented from moving, at least radially with respect to the rotational axis of the machine.

Such track-rings when fastened to the housing are unable to rotate, and "stiction" and friction frequently occurs between the stationary slippers and the annular surface of the track-ring, particularly when the machine is heavily loaded under rest. This can be a significant cause for the lower than desired starting torque efficiency when the machine is used as a hydrostatic motor. Generally, poor torque starting efficiency is perceived to be a bad aspect since it can cause difficulties arising, for instance, certain machine elements or components can, as a result, receive higher than desired levels of loading causing premature wear and a reduction in the useful working life of the machine.

SUMMARY OF THE INVENTION

From one aspect the invention consists of a radial piston hydrostatic machine of the fixed displacement type comprising a housing defining an internal chamber, a rotatable cylinder-barrel disposed within the chamber and provided with a series of cylinders each containing a piston, an annular track-ring surrounding the cylinder-barrel such that the pistons bear on the track-ring, abutment means in the housing lying generally radially adjacent the track-ring for controlling the eccentric position of the track-ring with respect to the axis of rotation of the rotatable cylinder-barrel and arranged to resist the action of the pistons in urging the track-ring in a direction towards the abutment means.

It is therefore an object of the invention to provide abutment means for the track-ring whereby the cyclic variation of the direction of the forces generated by the pistons is used to good effect by urging the track-ring against a vibration absorbing surface provided by the abutment means, without binding, and thereby effecting a substantial reduction in the prior level of vibration of prior track-ring designs. In the case of a bi-rotational directional hydrostatic machine, the abutment means comprises two abutment-members, and where each abutment-member is positioned to be in phase with a respective arcuate-slot provided in the pintle-valve or equivalent fluid distribution means such as an axial face distributor-valve. The track-ring is preferably cylindrical in shape and where the abutment-members are preferably of part-cylindrical concave shape with abutment-surfaces or bearing-surfaces available to be engaged by the outer convex bearing-surface or abutment-surface on the track-ring. The abutment-surfaces of the abutment means lie adjacent to the outer diameter of the track-ring, and may be provided with certain vibration absorbing and friction properties helping to negate vibration depending on the type of characteristic required. The fluid lodged between the engaging interfaces is under squeeze-film conditions and thereby acts in cushioning the vibration of the track-ring. The use of lubrication grooves and hydrostatic bearings on either the abutment-members or on the track-ring may also be used with good effect in this respect.

It is therefore a further object of the present invention to provide a machine with the track-ring having a self-aligning ability under load, such that the track-ring is able to move relative to the abutment means under load in a radial direction.

It is another object of the invention to simplify and improve the assembly procedure for the machine.

It is a further object of the present invention to improve the starting torque efficiency by allowing the track-ring to rotate in the housing between the abutment-members.

Although the embodiment of the invention described and illustrated here relates to the pintle-valve type of radial piston machine, the principles are also applicable with similar advantages to the axial distributor-valve type of radial piston machine. These and other objects of the invention will be apparent from reading the specification and referring to the embodiment herein illustrated.

BRIEF DESCRIPTION OF THE DRAWINGS

The invention may be performed in various ways and one specific embodiment over the conventional art will now described by way of example with reference to the accompanying drawings, in which.

Figure 1:
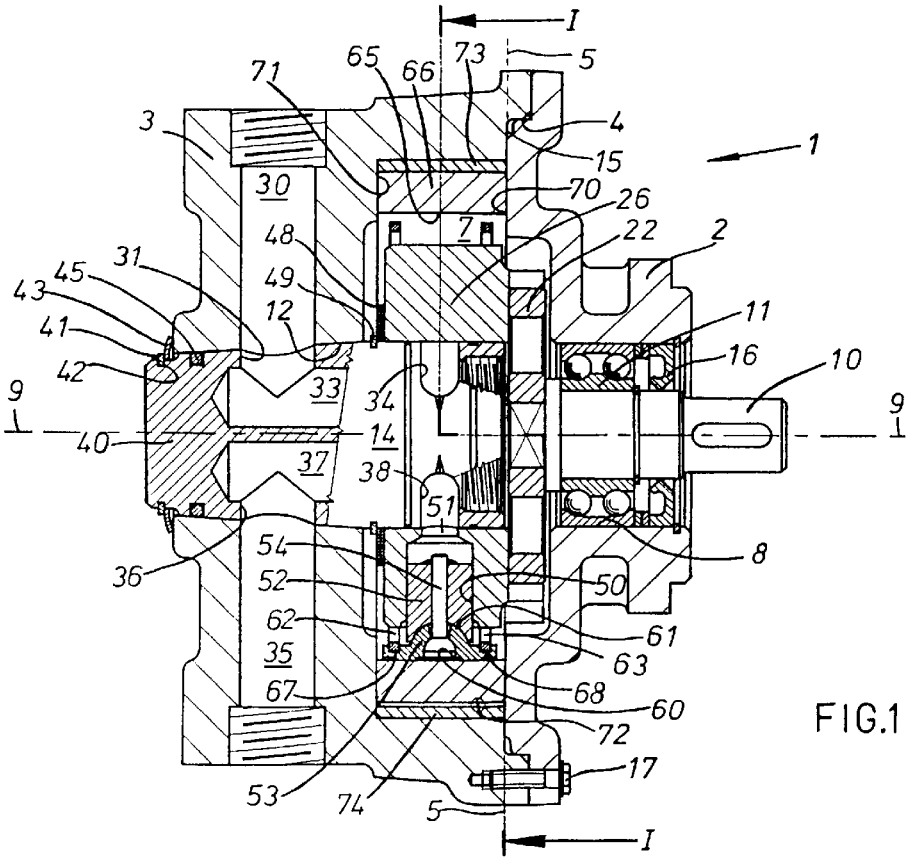
FIG. 1 is a sectional side view of the hydrostatic radial piston machine according to the invention.
Figure 2:
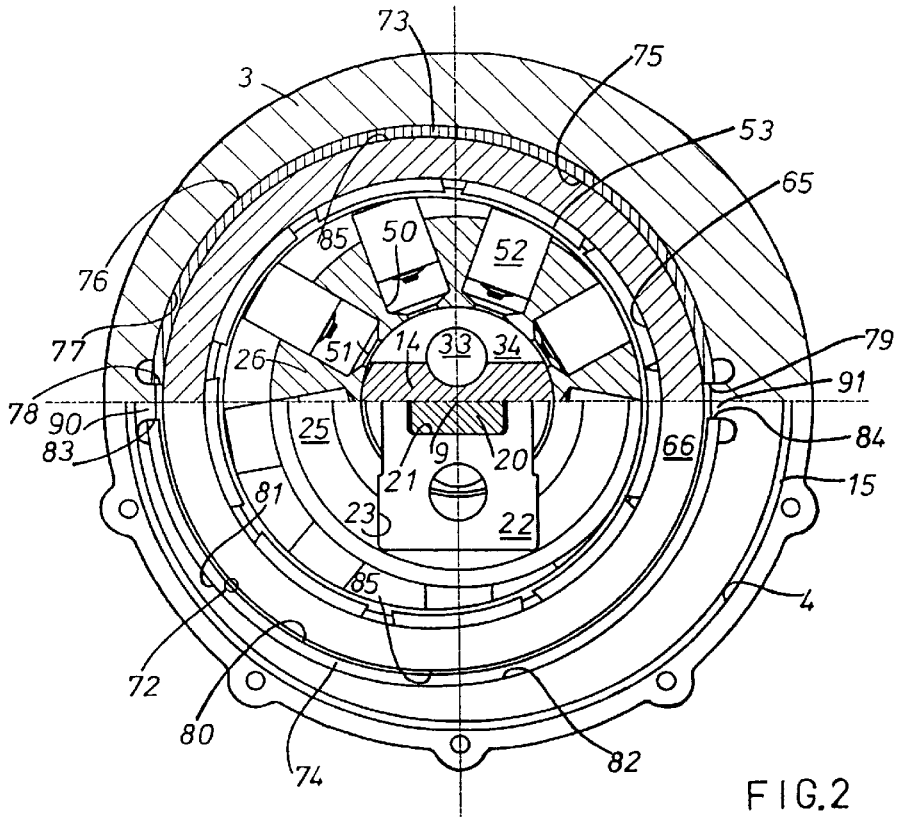
FIG. 2 is a sectional end view of the machine of FIG. 1 on the line I—I.

The housing structure for the machine 1 may comprise two or more housing elements such as shown referenced as 2, 3 that fit together on a register 4 along a parting-plane 5 arranged between them to define an internal chamber 7. Housing element 2 is provided with a central aperture 8 into which a rotary drive-shaft 10 is supported by means of bearing 11, and where the parting-plane 5 is arranged perpendicular to the rotational axis 9 of the drive-shaft 10 and cylinder-barrel 26. The machine 1 may use a pintle-valve 14 or an equivalent fluid distribution means such as a valve-plate. As illustrated, housing element 3 is provided with a central aperture 12 tapered along its longitudinal axis to receive the pintle-valve 14. An "O" ring type seal 15 adjacent said register 4 and rotary-seal 16 adjacent bearing 11 prevents fluid within internal chamber 7 from escaping, and a series of screws 17 are used to hold together housing elements 2, 3.

A tongue 20 provided on drive-shaft 10 fits into a corresponding slot 21 provided in an "oldham" type misalignment coupling 22, and where the coupling 22 fits into a slot 23 provided on the end face 25 of the cylinder-barrel 26.

A fluid admittance passage 30 for the machine 1 is provided in housing element 3 and which is arranged to connect by means of a pintle-slot 31 provided in the pintle-valve 14 to an internal longitudinal-passage 33 and where passage 33 connects with arcuate-slot 34.

Similarly, a fluid discharge passage 35 for the machine 1 is also provided in housing element 3 and which is arranged to connect by means of a pintle-slot 36 provided in the pintle-valve 14 to internal longitudinal-passage 37 and where passage 37 connects with arcuate-slot 38.

A common problem faced during the construction and assembly of some prior radial piston machines occurs when the pintle-valve is inserted into the housing element by a heat shrink process, such a pintle-valve being shown in U.S. Pat. No. 5,081,907. This prior assembly practice, which is not only difficult to perform, can result in the pintle-valve becoming incorrectly positioned (axially and well as angularly) in the housing, such that both components are wasted. In the machine 1 of the present invention, this prior problem is overcome by through the inclusion of a tapered interface between the shanked end portion 40 of pintle-valve 14 and the associated aperture 12 provided in the housing element 3.

Application of a sealing and retaining solution product such as the trade marked "Loctite 638" on the tapered surface of the shanked end portion 40 of the pintle-valve 14 before the pintle-valve 14 is inserted in aperture 12 ensures that a leak-tree sealed interface is obtained around the respective pairs of pintle-slots 31, 36 and connecting fluid-passages 30, 35.

A groove 42 is provided on the shanked end portion 40 of pintle-valve 14 into which circlip 41 is fitted so that resilient retaining means such as one or more disc springs 43 can be used to axial locate and hold fast the pintle-valve in place in housing element 3. As a further insurance against fluid leakage occuring at the interface between shanked end portion 40 aperture 12, an "O" ring seal 45 may be used, the advantage being that because the "O" ring 45 is located in the tapered portion on shank end 40, it cannot become damaged during assembly as could occur if such a seal on a parallel cylindrical pintle-valve is inserted into a tight fitting parallel aperture in the housing. According to the teachings in the present invention, assembly of the pintle-valve 14 to the housing element 3 is a comparatively simple task, as once the sealant has been applied on the shank-end 40 of pintle-valve 14, the pintle-valve 14 can be carefully and accurately positioned within aperture 12 before being fixedly held in place by fitting the disc spring 43 and circlip 41.

A pair of thrust-washers 48 and circlip 49 located near the mid-section of the pintle-valve 14 acts to locate the cylinder-barrel 26 axially in one direction, and where the position of drive-shaft 10 locates the cylinder-barrel in the opposite axial direction such that the cylinder-barrel is prevented from coming into contact with the adjacent interior housing walls 70, 71.

The cylinder-barrel 26 is supported for rotation on the pintle-valve 14 and includes a number of cylinders 50 each connected through a respective "necked" cylinder-port 51 to allow fluid distribution between each of the cylinders 50 and the respective pair of arcuate-slots 34, 38 formed on the periphery of the pintle-valve 14.

Each cylinder 50 contains a piston 52 which may be attached to a respective slipper 53 by means of a rivet 54. The longitudinal or shank portion of the rivet 54 is a relatively close fit inside an axial longitudinal hole provided in the piston 52, so allowing the required amount of pressurized fluid to bleed from the cylinder-bore 50 to reach the bearing-face 60 of the slipper 53 for the creation of a hydrostatic bearing in a manner well practiced in the art. Pistons 52 and slippers 53 mate together on a part-spherical socket 61 to allow articulation of the slipper 53 on the piston 52. Guidance-rings 62, 63 are provided and serve to keep the slippers 53 in close proximity with the annular surface 65 of the surrounding track-ring 66. Each of the guidance-rings 62, 63 are axially retained in respective grooves 67, 68 provided on the slipper 53, and thus the guidance-rings 62, 63 and the slippers 53 are preventing from making contact with the adjacent interior walls 70, 71 of the respective housing elements 2, 3.

The annular track-ring 66 is preferably of cylindrical shape and is positioned within said internal chamber 7 such that its axial position is controlled by adjacent interior walls 70, 71 of housings 2, 3, and where its radial position is controlled by surrounding abutment means.

The abutment means may comprise two part-cylindrical abutment-surfaces formed directly in the interior of the housing element, or preferably as illustrated, be comprised of two part-cylindrical shaped members referenced as abutment-members 73, 74. Each abutment-member 73, 74 is located in the interior of housing 3 to surround a portion of the circumferential length of the track-ring 66. In either case, the abutment means is used to resist the radial movement of the track-ring 66 caused by the influence of those pistons 52 experiencing fluid under pressure which urge the track-ring 66 to move radially in a direction towards either one of the two abutment-members 73, 74. The abutment-members 73, 74 may be formed from a material exhibiting a degree of elastic deformability when subjected to load, or may also be provided with lubrication grooves and or hydrostatic bearings if desired.

Abutment-member 73 is shaped or formed to provide a concave first part-cylindrical bearing-surface 75 and a part-cylindrical outer surface 76 which is located in a concave part-cylindrical recessed-pocket 77 provided in housing 3. Although preferably, the recessed-pocket 77 is of concave part-cylindrical shape as illustrated, it may alternatively also be flat in which case the outer surface of the abutment-member would be correspondingly shaped.

Similarly, abutment-member 74 is shaped or formed to provide a concave first part-cylindrical bearing-surface 80 and a part-cylindrical outer surface 81 which is located in a concave part-cylindrical recessed-pocket 82 provided in housing element 3.

Abutment-member 73 is prevented from rotating in the machine 1 because of contact at 78, 79 with inwardly projecting radial protrusions 90, 91 provided in housing 3. Similarly, abutment-member 74 is also prevented from rotating because of contact at 83, 84 with the inwardly projecting radial protrusions 90, 91.

The track-ring 66 can be also defined as a third abutment-member such that its outer cylindrical profile would be the third abutment-surface of convex shape. In this respect, concave bearing-surfaces 75, 80 of respective abutment-members 73, 74 are the first and second abutment-surfaces, and where the first and second bearing-surfaces describe a cylinder having a common axis offset from the rotational axis 9 of the machine 1 by an amount equal to half the piston stroke of said pistons 52.

The cylindrical track-ring 66 lies between the abutment-members 73, 74 and is purposely provided with sufficient radial clearance shown as gap 72 so that the track-ring 66 can contact with either one of said abutment-members 73, 74 depending on which one of the two arcuate-slots 34, 38 is at the higher pressure. When the track-ring 66 is in an unloaded condition, the gap 72 may be an annular clearance as the track-ring 66 might not then be in contact with either of the two abutment-members 73, 74. However, once the track-ring 66 is urged to move by the influence of the pistons 52, a small gap as shown as 72 will exist between the track-ring and one of the two abutment-members, unless the unloaded abutment-member is arranged to be lightly loaded by a weak external spring or similar to cause it to follow the radial movement of the track-ring towards the opposite piston-loaded abutment-member.

Operation of the Machine

The operation of the machine 1 is as follows: Fluid from an external source, such as a hydraulic pump, enters the machine 1 through the pressure fluid admittance passage 30 and passes by way of pintle-slot 31, longitudinal-passage 33, and arcuate-slot 34 to the interior of cylinder 50 via "necked" cylinder-port 51. With the track-ring 66 eccentrically positioned with respect to the axis of rotation 9, outward sliding movement of the pistons 52 in their respective cylinder 50 occurs. As some of the slippers 53 are at an angle in relation to the longitudinal axis of the pistons 52, a lateral force is created between the piston 52 and its surrounding walls of cylinders 50, and a turning moment is created on the cylinder-barrel 26. Rotation of the cylinder-barrel 26 causes the coupling 22 and drive-shaft 10 to rotate. Once the pistons 52 have completed their outward motion, they return inwards in its their respective cylinders 50, and the low-pressure fluid is expelled from the interior of cylinders 50 via "necked" cylinder-port 51 into the opposite arcuate-slot 38 from where it is directed along longitudinal-passage 37 to reach the low-pressure fluid discharge passage 35 to return to a fluid reservoir.

When the level of fluid pressure is higher in arcuate-slot 34 than in arcuate-slot 38, the general direction of forces from the working pistons 52 of the machine 1 as they act through their respective slippers 53 against the annular surface 65 of the track-ring 66 causes the outer convex bearing-surface 85 of the track-ring 66 to engage with the concave part-cylindrical bearing-surface 75 of abutment-member 73. These bearing-surfaces 75, 85 are thereby urged together without seizing due to the cyclic variation in the direction of the piston forces. At the same time, the outer convex bearing-surface 85 of the track-ring 66 is disengaged from the other concave part-cylindrical bearing-surface 80 of abutment-member 74.

During reverse machine operation, arcuate-slot 38 is at a higher level than arcuate-slot 34, and the action of the piston forces is such that the track-ring 66 now moves towards the second abutment-member 74 to engage with the concave part-cylindrical bearing-surface 80.

I claim:

1. A hydraulic radial piston machine of the fixed-displacement type comprising a housing defining an internal chamber, a cylinder-barrel rotatable about an axis and disposed within said internal chamber and an annular track-ring having a self-aligning ability when loaded surrounding said cylinder-barrel and being eccentrically disposed relative to said axis, said cylinder-barrel being provided with a series of cylinders each containing a piston such that the pistons in said cylinders bear their loads on said track-ring, abutment means in the interior of said housing comprising first and second abutment surfaces of part-cylindrical shape, said track ring being arranged to lie between and generally radially adjacent to said first and second abutment surfaces with sufficient radial clearance such that said pistons urge said track ring to engage the first abutment surface and disengage from the second abutment surface or vice versa, fluid distribution means in said housing comprising a pair of angularly spaced arcuate slots arranged to fluidly connect with said cylinders of said cylinder-barrel, said first and second abutment surfaces being angularly spaced within said housing to be substantially in phase with a respective one of said arcuate slots, radial movement of said track ring occurring in a direction toward either one of said first and second abutment surfaces depending on which of said arcuate slots is at the higher pressure.

2. A hydraulic radial piston machine according to claim 1 wherein said fluid distribution means includes a pintle-valve, said pintle-valve being fixedly and non-rotatably mounted in said housing to extend into said internal chamber to rotatably support said cylinder-barrel and said pair of angularly spaced arcuate-slots being formed on the periphery of said pintle-valve.

3. A hydraulic radial piston machine according to claim 1 wherein said abutment means is an integral part of said housing and wherein said track-ring is cylindrical in shape and wherein an initial annular clearance space is provided between said track-ring and said first and second abutment-surfaces.

4. A hydraulic radial piston machine according to claim 1 wherein said track-ring is cylindrical in shape and is able to rotate between said first and second abutment surfaces.

5. A hydraulic radial piston machine according to claim 1 wherein said first and second abutment-surfaces extend circumferentially towards one another to substantially surround the circumference of said track-ring.

6. A hydraulic radial piston machine according to claim 1 wherein said fluid distribution means comprises a pintle-valve or equivalent valve-plate fluid distribution means, and said track-ring is cylindrical in shape and is able to rotate between said first and second abutment surfaces.

7. A hydraulic radial piston machine according to claim 1 wherein said first and second abutment surfaces are formed on respective abutment members attached to said housing interior.

8. A hydraulic radial piston machine according to claim 8 wherein said fluid distribution means includes a pintle-valve, said pintle-valve being fixedly and non-rotatably mounted in said housing to extend into said internal chamber to rotatably support said cylinder-barrel and wherein said pair of angularly spaced arcuate-slots are formed on the periphery of said pintle-valve.

9. A hydraulic radial piston machine according to claim 7 wherein said track-ring is cylindrical in shape and is able to rotate between said first and second abutment-members.

10. A hydraulic radial piston machine according to claim 7 wherein said first and second abutment-members extend circumferentially towards one another to substantially surround the circumference of said track-ring.

11. A hydraulic radial piston machine according to claim 7 wherein said fluid distribution means comprises a pintle-valve or equivalent valve-plate fluid distribution means, and said track-ring is cylindrical in shape and is able to rotate between said first and second abutment surfaces.

12. A hydraulic radial piston machine according to claim 7 wherein the interior of said housing is provided with first and second recessed-pockets into which said first and second abutment-members are retained respectively and thereby restrained from rotational movement, said abutment surfaces on respective first and second abutment members being positioned radially inwardly of said first and second recessed pockets.

13. A hydraulic radial piston machine according to claim 7 wherein the interior of said housing is provided with first and second recessed-pockets of concave part-cylindrical shape into which said first and second abutment-members are retained respectively, the circumferentially spaced ends of each of said first and second abutment-members lying adjacent to respective inwardly projecting radial protrusions of said housing to restrain said first and second abutment-members from rotational movement, said abutment surfaces on respective first and second abutment members being positioned radially inwardly of said protrusions.

14. A hydraulic radial piston machine according to claim 7 wherein said housing comprises at least two housing elements, and wherein said first and second abutment members extend circumferentially towards one another to substantially surround the circumference of said track-ring.

15. A hydraulic radial piston machine of the positive displacement type comprising a housing defining an internal chamber, a cylinder-barrel rotatable about an axis and disposed within said internal chamber and an annular track-ring having a self-aligning ability when loaded surrounding said cylinder-barrel, said cylinder-barrel being provided with a series of cylinders each containing a piston such that the pistons in said cylinders bear their loads on said track-ring, fluid distribution means in said housing comprising a pair of angularly spaced arcuate slots arranged to fluidly connect with said cylinders of said cylinder-barrel, abutment means in said housing including a first abutment surface comprising a concave first part-cylindrical bearing surface and a second abutment surface comprising a concave second part-cylindrical bearing surface, the first and second bearing surfaces being arranged to lie radially adjacent to a convex third bearing surface formed by said track-ring with sufficient radial clearance such that said pistons urge said third bearing surface to engage said first bearing surface and disengage from said second bearing surface or vice versa, depending on which one of said pair of arcuate slots is distributing fluid at a higher pressure, and wherein said first and said second abutment surfaces are angularly spaced within said housing to be substantially in phase with said arcuate slots.

16. A hydraulic radial piston machine of the positive displacement type comprising a housing defining an internal chamber, said housing being provided with one of more internal fluid-passages, a drive-shaft supported by at least one bearing in said housing and driving a cylinder-barrel rotatable about an axis and disposed within said internal chamber, a pintle-valve supported in said housing and extending into said internal chamber to support said cylinder barrel, an annular track-ring having a self-aligning ability when loaded surrounding said cylinder-barrel, said track-ring being eccentrically positioned with respect to said cylinder-barrel, said cylinder-barrel being provided with a series of cylinders each containing a piston such that the pistons bear their loads on said track-ring, a pair of arcuate-slots formed on the periphery of said pintle-valve and arranged to fluidly connect with said cylinders of said cylinder-barrel, abutment means in said housing and comprising first and second abutment-surfaces, said first and second abutment-surfaces being angularly spaced within said housing to be substantially in phase with said arcuate-slots and lying generally radially adjacent to said track ring, said track-ring being provided with a degree of radial freedom to move relative to the radial position of said cylinder-barrel such that said pistons urge said track ring to engage the first abutment surface and disengage the second abutment surface or vice versa, depending on whichever one of said pair of arcuate slots is subjected to the higher pressure.

17. A hydraulic radial piston machine according to claim 16 wherein said track-ring is able to rotate in said internal chamber relative to said first and second abutment surfaces.

* * * * *